United States Patent [19]

Duerksen et al.

[11] 4,448,701

[45] May 15, 1984

[54] AQUEOUS CUTTING FLUID FOR MACHINING FISSIONABLE MATERIALS

[75] Inventors: Walter K. Duerksen, Norris; John M. Googin, Oak Ridge; Bradley Napier, Jr., Powell, all of Tenn.

[73] Assignee: The United States of America as represented by the United States Department of Energy, Washington, D.C.

[21] Appl. No.: 343,608

[22] Filed: Jan. 28, 1982

[51] Int. Cl.[3] ..... C10M 3/04

[52] U.S. Cl. ..... 252/49.3

[58] Field of Search ..... 252/49.3, 52 A

[56] References Cited

U.S. PATENT DOCUMENTS 2,958,659 11/1960 Brown ..... 252/49.3
3,000,826 9/1961 Gililland ..... 252/49.3
3,450,576 6/1969 Sprague ..... 252/49.3 X
3,629,112 12/1971 Gower et al. ..... 252/49.3 X

OTHER PUBLICATIONS

Rodenbusch, Chem. Abs., vol. 65, 16745 b, 1966, "Lubricants and Nuclear Radiation".

"The Condensed Chemical Dictionary", 1977, p. 120, Boron.

*Primary Examiner*—Andrew Metz

*Attorney, Agent, or Firm*—Earl L. Larcher; Stephen D. Hamel; Richard G. Besha

[57] ABSTRACT

The present invention is directed to a cutting fluid for machining fissionable material. The cutting fluid is formed of glycol, water and boron compound in an adequate concentration for effective neutron attenuation so as to inhibit criticality incidents during machining.

1 Claim, No Drawings

AQUEOUS CUTTING FLUID FOR MACHINING FISSIONABLE MATERIALS

This invention was made as a result of a contract of the U.S. Department of Energy.

BACKGROUND OF THE INVENTION

The present invention is directed to a cutting fluid for use in metal working operations, and more particularly to a cutting fluid for cooling and lubricating tools used for the machining and grinding of fissionable materials.

In metal machining operations, the machining or cutting fluids have a primary function of cooling and lubricating the tool and the workpiece. Other functions of the cutting fluids are also important in that the cutting fluid must possess a sufficiently low viscosity which allows for free flow without excessive leakage or evaporation. The cutting fluid must also be stable over a broad range of temperatures and undergo mechanical shear and stresses without breaking down. The cutting fluid should also comply with various environmental and health standards so as to be within safety regulations such as listed by the Environmental Protection Agency especially for continued utilization of the fluid.

While cutting fluids must provide the aforementioned properties, the machining of fissionable material by using cutting tools and grinders imposes an additional requirement upon the cutting fluid in that the latter must also posses the capability of inhibiting excursions such as caused by the formation of critical configurations of machine turnings and chips. The machining fluid commonly utilized is formed of 40 vol. % perchloroethylene and 60 vol. % mineral oil. However, the vapor pressure of perchloroethylene is 20 mm of mercury at 26.3° C. and is thus excessively volatile under most environmental conditions which considerably detracts from its use.

SUMMARY OF THE INVENTION

Accordingly, it is the primary aim or goal of the present invention to provide a cutting fluid for machining operations on fissionable material. This cutting fluid possesses the necessary aforementioned properties required of the cutting fluid such as necessary for cooling and lubricating the tool and workpiece as well as meeting various environmental standards. The cutting fluid also incorporates a component capable of absorbing thermal neutrons as well as a moderator, which together inhibits the occurance of any critical incidents during machining. Generally, the cutting fluid of the present invention comprises an admixture of glycol, water, and an adequate concentration of a boron compound for effective neutron attenuation.

Other and further objects of the invention will be obvious upon an understanding of the illustrative embodiment about to be described or will be indicated in the appended claims, and various advantages not referred to herein will occur to one skilled in the art upon employment of the invention in practice.

DETAILED DESCRIPTION OF THE INVENTION

As briefly described above, the present invention is directed to a cutting fluid for use in the machining of fissionable materials such as plutonium and uranium wherein the cutting fluid provides the necessary cooling and lubrication of the workpiece as well as meeting various environmental standards which permits its use over a long duration. The cutting-fluid formulation of the present invention comprises a glycol selected from the group consisting of ethylene glycol and propylene glycol, a boron compound selected from the group consisting of boric acid sodium tetraborate decahydrate, and water.

The concentrations of the various cutting fluid components are about 35–65 vol. % of the glycol, about 35–65 vol. % water and about 5–12 grams of the boron compound per 100 ml of liquid.

The cutting fluid requires a concentration of the boron compound of about 7.3 gm/100 ml for adequate thermal neutron attenuation during the machining of highly enriched fissionable material but with low enrichment levels, a boron concentration of about 5.0 gm/100 ml is adequate. This boron compound also functions as biocide with a concentration of about 0.5 gm per liter of solution. This boron compound is an effective absorber of slow neutrons due to its relatively large neutron cross section. This boron compound functions together with the water, which is a neutron moderator, to provide adequate protection against a critical accident or excursion while machining workpieces of fissionable material.

The glycol provides the necessary lubrication and the mixture provides the necessary cooling of the tool and workpiece during machine operation. The particular glycol compound selected has a sufficiently high vapor pressure so as to be acceptable under EPA standards at conventional machining temperatures. The water, on the other hand, is a highly effective coolant because of its high specific heat of evaporation and low viscosity and functions together with the boron due to its neutron moderating properties to further inhibit the possibility of an excursion. However, the use of water without the boron compound in the cutting fluid would be undesirable and would probably lead or help instigate a criticality situation. The formulation, in general, is nonflammable and thermally stable, free of toxic and carcinogenic compounds, noncorrosive with a fissionable metal such as uranium or plutonium and alloys thereof, is not vulnerable to biological degradation as formulated, and is environmentally acceptable and biodegradable when diluted.

The formulation was tested on depleted uranium for 3 weeks and exhibited excellent machining coolant cutting fluid properties for rough and finished cuttings on the uranium metal. The preferred composition for machining enriched uranium and plutonium is 50 vol. % propylene glycol, 50 vol. % water and 9.8 grams of sodium tetraborate decahydrate per 100 ml of the liquid. The sodium tetraborate decahydrate was dissolved in the glycol-water solution.

The corrosion rate of the cutting fluid formulation on uranium was determined by submerging uranium coupons in the formulation for a period of time ranging from 1 to 21 days. The uranium coupons were 1 inch squares with a thickness of 0.125 inch. The coupons were weighed before and after submersion in the cutting fluid and exhibited a very small weight loss during so as to indicate that corrosion of the uranium coupons was in fact negligible.

It will be seen that the present invention provides a cutting fluid for machining fissionable materials which meets acceptable machine standards as well as provides a mechanism for inhibiting criticality incidents during the machining of fissionable material.

What is claimed is:

1. A cutting fluid for machining fissionable materials consisting of an admixture of water, 35–65 vol. % of a glycol selected from the group consisting of ethylene glycol and propylene glycol, and a boron compound selected from the group consisting of boric acid and sodium tetraborate decahydrate with said boron compound being dissolved in the admixture in an effective neutron attenuating concentration in the range of about 5–12 grams/100 ml of the admixture.

* * * * *